US009984804B2

(12) United States Patent
Park et al.

(10) Patent No.: US 9,984,804 B2
(45) Date of Patent: May 29, 2018

(54) COIL COMPONENT

(71) Applicant: SAMSUNG ELECTRO-MECHANICS CO., LTD., Suwon-Si, Gyeonggi-Do (KR)

(72) Inventors: Jong Ik Park, Suwon-Si (KR); Min Sung Choi, Suwon-Si (KR); Jae Yeol Choi, Suwon-Si (KR); Jin Mo Ahn, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days. days.

(21) Appl. No.: 14/940,128

(22) Filed: Nov. 12, 2015

(65) Prior Publication Data

US 2016/0217909 A1 Jul. 28, 2016

(30) Foreign Application Priority Data

Jan. 27, 2015 (KR) ..... 10-2015-0012672

(51) Int. Cl.
*H01F 5/00* (2006.01)
*H01F 17/00* (2006.01)
(Continued)

(52) U.S. Cl.
CPC ..... *H01F 17/0013* (2013.01); *H01F 17/04* (2013.01); *H01F 27/292* (2013.01); *H01F 2017/048* (2013.01)

(58) Field of Classification Search
CPC .... H01F 27/2804; H01F 27/29; H01F 27/255; H01F 17/0006
(Continued)

(56) References Cited

U.S. PATENT DOCUMENTS 3,836,881 A 9/1974 Koizumi
6,294,976 B1 9/2001 Imada et al.
(Continued)

FOREIGN PATENT DOCUMENTS

CN 1434468 A 8/2003
CN 102760551 A 10/2012
(Continued)

OTHER PUBLICATIONS

Chinese Office Action dated Mar. 31, 2017 issued in Chinese Patent Application No. 201510849718.2 (with English translation).
(Continued)

*Primary Examiner* — Mangtin Lian
(74) *Attorney, Agent, or Firm* — McDermott Will & Emery LLP

(57) ABSTRACT

A coil component includes a magnetic body including first and second coil patterns respectively disposed on first surfaces of two substrates spaced apart from each other and having cores and third and fourth coil patterns respectively disposed on second surfaces of the two substrates; and first to fourth external electrodes disposed on outer peripheral surfaces of the magnetic body and connected to the first to fourth coil patterns, respectively. A gap member is disposed between the two substrates while being located in at least one of upper and lower regions of the magnetic body in a thickness direction.

15 Claims, 6 Drawing Sheets

(51) Int. Cl.
*H01F 17/04* (2006.01)
*H01F 27/29* (2006.01)

(58) Field of Classification Search
USPC ..... 336/200, 233, 223, 192, 170
See application file for complete search history.

(56) References Cited

U.S. PATENT DOCUMENTS

| | | | | |
|---|---|---|---|---|
| 6,998,951 | B2 | 2/2006 | Itou et al. | |
| 2001/0030593 | A1* | 10/2001 | Imada | H01F 17/0013 336/200 |
| 2003/0085777 | A1 | 5/2003 | Kim et al. | |
| 2003/0137384 | A1* | 7/2003 | Itou | H01F 17/0013 336/200 |
| 2012/0274435 | A1 | 11/2012 | Jeong et al. | |
| 2013/0169404 | A1* | 7/2013 | Jeong | H01F 27/2804 336/200 |
| 2014/0184374 | A1 | 7/2014 | Park et al. | |
| 2015/0002256 | A1 | 1/2015 | Bourns et al. | |
| 2015/0015358 | A1* | 1/2015 | Yokoyama | H01F 17/0013 336/200 |
| 2015/0179323 | A1 | 6/2015 | Uemoto et al. | |

FOREIGN PATENT DOCUMENTS

| | | | |
|---|---|---|---|
| CN | 202650818 | U | 1/2013 |
| JP | 3650949 | B2 | 5/2005 |
| JP | 2005-317775 | A | 11/2005 |
| JP | 2014-027050 | A | 2/2014 |
| KR | 10-2003-0037747 | A | 5/2003 |
| KR | 10-2005-0011090 | A | 1/2005 |

OTHER PUBLICATIONS

Chinese Office Action issued in corresponding Chinese Patent Application No. 201510849718.2, dated Dec. 11, 2017 (with English translation).

* cited by examiner

COIL COMPONENT

CROSS-REFERENCE TO RELATED APPLICATION

This application claims the priority and benefit of Korean Patent Application No. 10-2015-0012672, filed on Jan. 27, 2015 with the Korean Intellectual Property Office, the entirety of which is incorporated herein by reference.

BACKGROUND

The present disclosure relates to a coil component and a board having the same.

Transmitting and receiving data in a high frequency band is a widely used function of electronic products such as digital televisions (TVs), smartphones, laptop computers, and the like. In the future, it is expected that these IT electronic products will not only be used as one device, but will also be connected to each other through a universal serial bus (USB) or another communications port, and thus they will be multifunctionalized and have a high degree of complexity.

In accordance with the development of smartphones, demand for a thinner power inductor having a high current, high efficiency, high performance, and small size has increased.

Therefore, a product having a size of 2016 (2.0 mm length and 1.6 mm width) and a thickness of 1 mm, which is less than that of a product having a size of 2520 (2.5 mm length and 2.0 mm width) and a thickness of 1 mm used in the past, has currently been developed. In the future, it is expected that it will be miniaturized to have a size of 1608 (1.6 mm length and 0.8 mm width) and a thickness of 0.8 mm.

Concurrently, demand for a power inductor array having advantages such as a reduced mounting area has also increased.

A power inductor array may have a non-coupled or coupled inductor form or a mixed form of the non-coupled inductor form, the coupled inductor form depending on a coupling coefficient or mutual inductance between a plurality of coil patterns.

Therefore, power inductor array products have been made available. However, due to various integrated chip (IC) operations, efficiency, and performance demands of customers, a product capable of controlling several kinds of coupling values is required.

SUMMARY

An aspect of the present disclosure provides a coil component and a board having the same.

According to an aspect of the present disclosure, a coil component comprises a magnetic body including first and second coil patterns respectively disposed on first surfaces of two substrates spaced apart from each other and having cores and third and fourth coil patterns respectively disposed on second surfaces of the two substrates; and first to fourth external electrodes disposed on outer peripheral surfaces of the magnetic body and connected to the first to fourth coil patterns, respectively, wherein a gap member is disposed between the two substrates while being located in at least one of upper and lower regions of the magnetic body in a thickness direction.

The gap member may have a shape of a bar extended to be in contact with both internal side surfaces of the magnetic body in a width direction.

The gap member may be a printed gap member.

The gap member may be made of the same material as an insulating material disposed on the first to fourth coil patterns.

A protrusion portion may be disposed on a side surface of at least one of the two substrates.

The first and second external electrodes may be provided as input terminals, and the third and fourth external electrodes may be provided as output terminals.

The first to fourth coil patterns may contain at least one selected from the group consisting of gold (Au), silver (Ag), platinum (Pt), copper (Cu), nickel (Ni), palladium (Pd), and alloys thereof.

The substrates may be magnetic substrates.

According to another aspect of the present disclosure, a coil component comprises a magnetic body including first and second coil patterns respectively disposed on first surfaces of two substrates spaced apart from each other and respectively having a core and third and fourth coil patterns respectively disposed on second surfaces of the two substrates; and first to fourth external electrodes disposed on outer peripheral surfaces of the magnetic body and connected to the first to fourth coil patterns, respectively, wherein a gap member is disposed between the two substrates while being located on at least one of both internal side surfaces of the magnetic body in a width direction.

An insulating material may be disposed on the first to fourth coil patterns.

The gap member may contain an epoxy resin.

The magnetic body may contain a metal based soft magnetic material having a particle size of 0.1 μm to 30 μm dispersed in a polymer selected from the group consisting of an epoxy resin and a polyimide.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
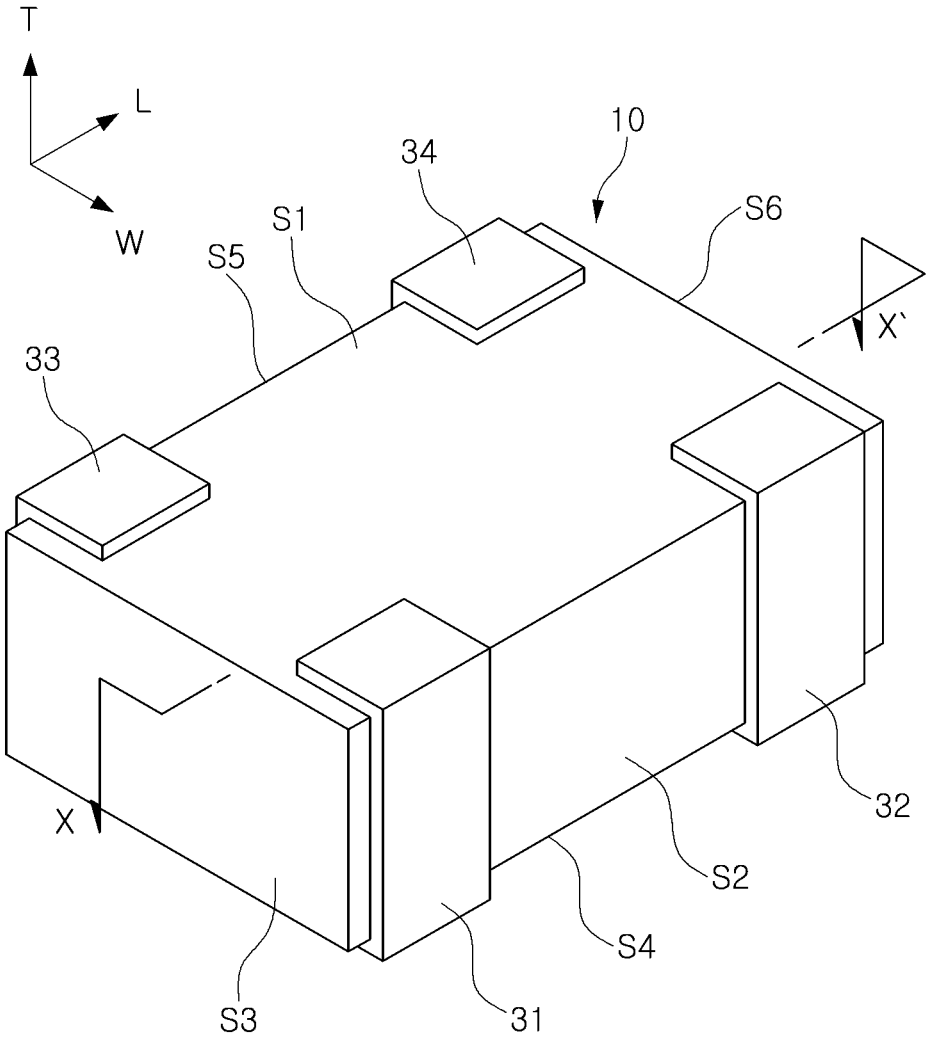
FIG. 1 is a perspective view of a coil component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Coil Component

FIG. 1 is a perspective view of a coil component according to an exemplary embodiment.

Figure 2:
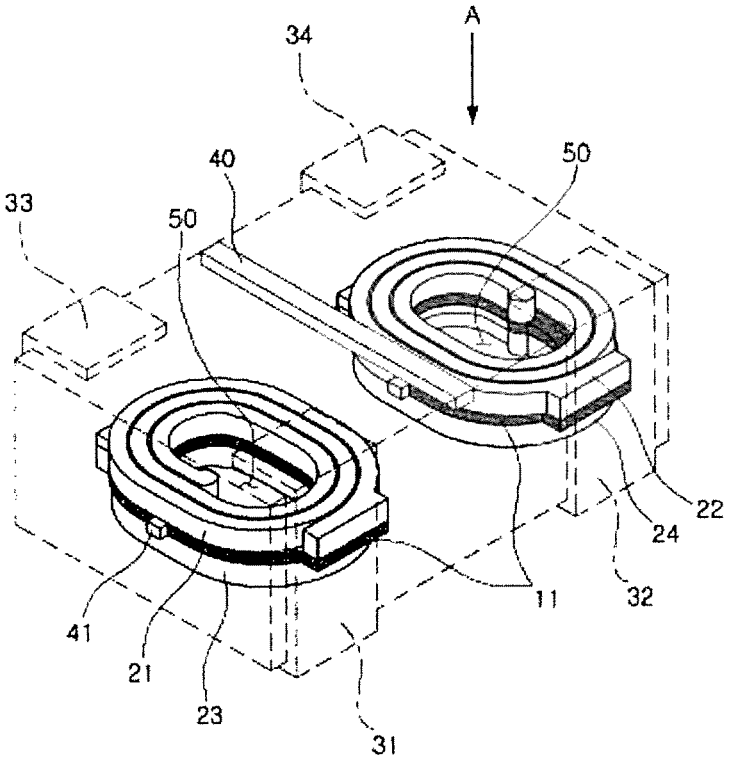
FIG. 2 is a perspective view of external electrodes and a magnetic body of the coil component according to an exemplary embodiment in the present disclosure.

FIG. 2 is a perspective view of external electrodes and a magnetic body of the coil component according to an exemplary embodiment.

Referring to FIGS. 1 and 2, the coil component may include a magnetic body 10 including first and second coil patterns 21 and 22 respectively disposed on first surfaces of two substrates 11 spaced apart from each other and respectively having a core and third and fourth coil patterns 23 and 24 respectively disposed on second surfaces of the two substrates 11, and first to fourth external electrodes 31 to 34 disposed on outer peripheral surfaces of the magnetic body 10 and connected to the first to fourth coil patterns 21 to 24, respectively.

In the present exemplary embodiment, terms "first" to "fourth" are used only to distinguish objects from each other, and are not limited to this sequence.

The magnetic body 10 may have a hexahedral shape, and an "L direction" refers to a "length direction", a "W direction" refers to a "width direction", and a "T direction" refers to a "thickness direction".

The magnetic body 10 may have upper and lower surfaces S1 and S4 opposing each other, first and second end surfaces S3 and S6 connecting the upper and lower surfaces S1 and S4 and opposing each other in the length direction, and first and second side surfaces S2 and S5 connecting the upper and lower surfaces S1 and S4 and opposing each other in the width direction.

The magnetic body 10 may include the two substrates 11 spaced apart from each other and having the cores, and may include the first and second coil patterns 21 and 22 and the third and fourth coil patterns 23 and 24 disposed on upper and lower surfaces of the two substrates 11, respectively, and enclosed by an insulating layer.

For instance, the first and third coil patterns 21 and 23 may be disposed, respectively, on upper and lower surfaces of one substrate having the core, and the second and fourth coil patterns 22 and 24 may be disposed, respectively, on upper and lower surfaces of the other substrate having the core.

The shape of the magnetic body 10 may form a shape of an inductor array and may be formed of any material that exhibits magnetic properties. For example, the magnetic body 10 may be formed by providing ferrite or a metal based soft magnetic material.

For the ferrite, an Mn—Zn based ferrite, an Ni—Zn based ferrite, an Ni—Zn—Cu based ferrite, an Mn—Mg based ferrite, a Ba based ferrite, an Li based ferrite, or the like, may be used.

The metal based soft magnetic material may be an alloy containing at least one selected from the group consisting of iron (Fe), silicon (Si), chromium (Cr), aluminum (Al), and nickel (Ni). For example, the metal based soft magnetic material may contain Fe—Si—B—Cr based amorphous metal particles, but is not limited thereto.

The metal based soft magnetic material may have a particle size of 0.1 μm to 30 μm and may be contained in a polymer such as an epoxy resin, polyimide, or the like, in a form in which it is dispersed in the polymer.

The substrate 11 may be a magnetic substrate, and a magnetic material contained in the magnetic substrate may include nickel-zinc-copper ferrite, but is not limited thereto.

In addition, the coil component, according to an exemplary embodiment, may include the first and second external electrodes 31 and 32 formed on a first surface of the magnetic body 10 and the third and fourth external electrodes 33 and 34 formed on a second surface of the magnetic body 10 opposing the first surface of the magnetic body 10.

Next, the first to fourth coil patterns 21 to 24 and the first to fourth external electrodes 31 to 34, as well as a gap member 40, will be described.

Figure 3:
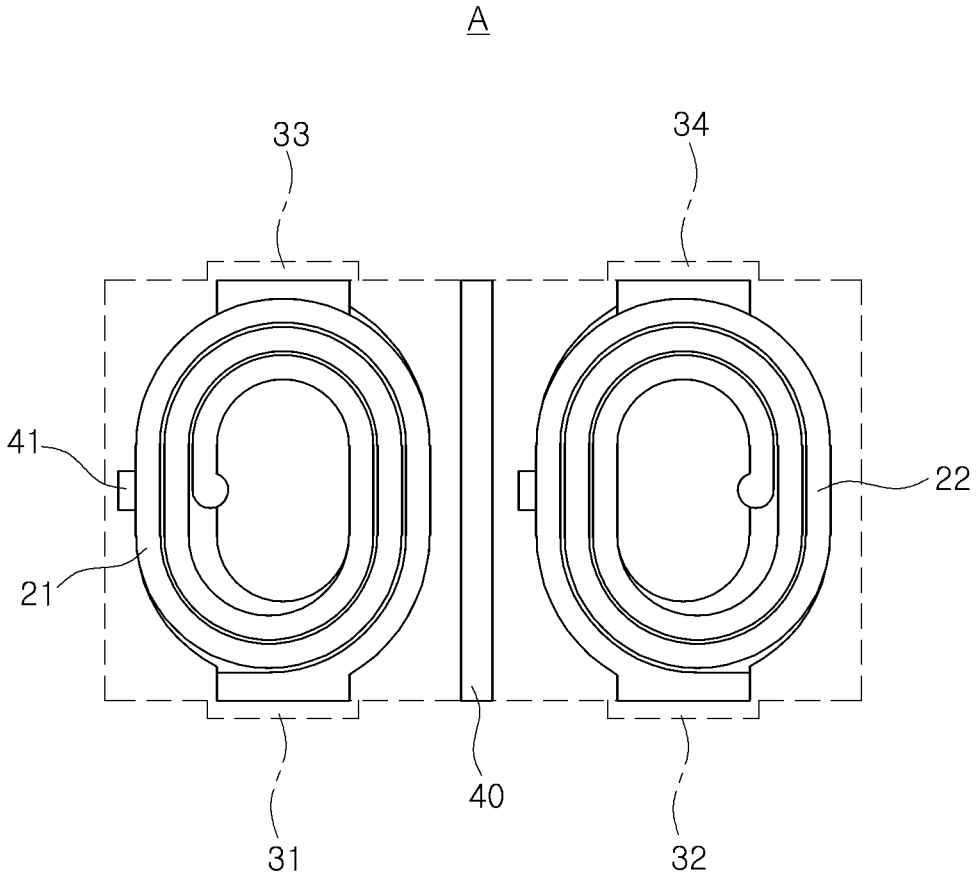
FIG. 3 is a plan view when viewed in direction A of FIG. 2.

FIG. 3 is a plan view when viewed in direction A of FIG. 2.

Figure 4:
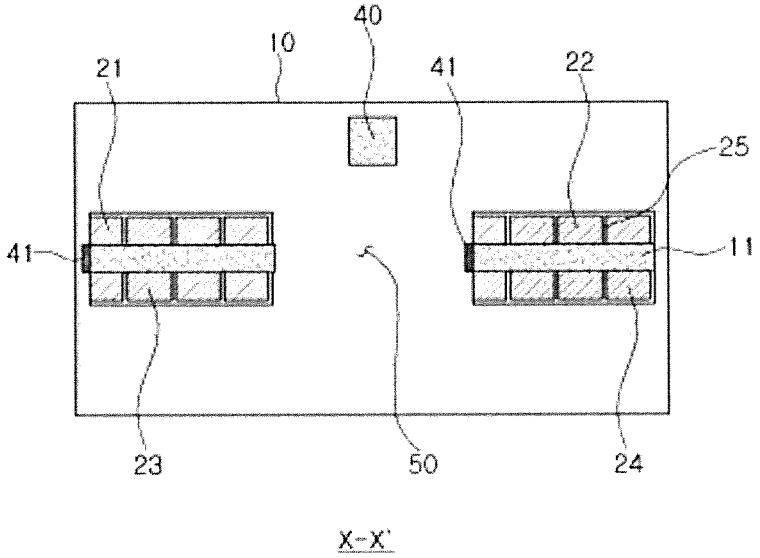
FIG. 4 is a cross-sectional view taken along line X-X' of FIG. 1.

FIG. 4 is a cross-sectional view taken along line X-X' of FIG. 1.

Referring to FIGS. 3 and 4, the first and second coil patterns 21 and 22 may be disposed on a first surface of the substrate 11 to be spaced apart from each other and be in parallel with each other, and may be wound in a state in which they are spaced apart from each other in the length direction of the magnetic body 10 on the same plane.

In addition, the third and fourth coil patterns 23 and 24 may be disposed on a second surface of the substrate 11 to be spaced apart from each other and be in parallel with each other, and may be wound in a state in which they are spaced apart from each other in the length direction of the magnetic body 10 on the same plane.

Therefore, a basic structure of the coil component according to an exemplary embodiment may be a coupled inductor array form, and the gap member 40 may be disposed at a central portion of the magnetic body 10 in the thickness direction, to be described below.

The first and second coil patterns 21 and 22 may be disposed to be symmetrical to each other in relation to a central portion of the magnetic body 10 in the length direction.

In addition, the third and fourth coil patterns 23 and 24 may be disposed to be symmetrical to each other in relation to a central portion of the magnetic body 10 in the length direction.

The first and second coil patterns 21 and 22 may have a symmetrical structure in which they are mirrored in relation to the central portion of the magnetic body 10, and the third and fourth coil patterns 23 and 24 may also have a symmetrical structure in which they are mirrored in relation to the central portion of the magnetic body 10.

The central portion of the magnetic body 10 is defined as a central region of the magnetic body in the length direction, and does not mean a point spaced apart from both end portions of the magnetic body 10 in the length direction by exactly the same distance.

In a shape in which the first and second coil patterns 21 and 22 are wound, a magnetic center in each of the first and second coil patterns 21 and 22 is called a core. Hereinafter, the core will be used as this concept.

In addition, in shapes in which the third and fourth coil patterns 23 and 24 are wound on the second surface of the substrates 11, a magnetic center may be called a core, and thus the substrate 11 may include two substrates respectively having a core.

According to an exemplary embodiment, since the first and second coil patterns 21 and 22 are symmetrical to each other in relation to the center of the magnetic body and the third and fourth coil patterns 23 and 24 are symmetrical to each other in relation to the center of the magnetic body, an inductance value formed by the first and second coil patterns 21 and 22 and an inductance value formed by the third and fourth coil patterns 23 and 24 may be the same.

In addition, ends of the first and second coil patterns 21 and 22 may be exposed to a first surface of the magnetic body 10 in the width direction, and ends of the third and fourth coil patterns 23 and 24 may be exposed to a second surface of the magnetic body in the width direction, and thus the first to fourth coil patterns 21 to 24 may be connected to the first to fourth external electrodes 31 to 34, respectively.

For instance, one end of the first coil pattern 21 may be exposed to a first surface of the magnetic body 10 in the width direction, and one end of the second coil pattern 22 wound in parallel with the first coil pattern 21 and in the same direction as a direction in which the first coil pattern 21 is wound on the same plane as a plane on which the first coil pattern 21 is wound may be exposed to the first surface of the magnetic body 10 in the width direction.

One end of the first coil pattern 21 exposed as described above may be connected to the first external electrode 31, and one end of the second coil pattern 22 exposed as described above may be connected to the second external electrode 32.

Likewise, one end of the third coil pattern 23 disposed on the lower surface of the substrate 11 may be exposed to a second surface of the magnetic body 10 in the width direction, and may be exposed to a position spaced apart from a position to which the fourth coil pattern 24 is exposed.

In addition, one end of the fourth coil pattern 24 disposed to be in parallel with and be spaced apart from the third coil pattern 23 on the same plane as a plane on which the third coil pattern 23 is disposed may be exposed to the second surface of the magnetic body 10 in the width direction, and may be exposed to a position spaced apart from the position to which the third coil pattern 23 is exposed.

One end of the third coil pattern 23 exposed as described above may be connected to the third external electrode 33, and one end of the fourth coil pattern 24 exposed as described above may be connected to the fourth external electrode 34.

As described above, the first and second coil patterns 21 and 22 and the third and fourth coil patterns 23 and 24 may be exposed to first and second surfaces of the magnetic body 10, respectively, to be spaced apart from each other, respectively, and thus they may be connected to the first to fourth external electrodes 31 to 34, respectively.

The first and second external electrodes 31 and 32 may be input terminals, and the third and fourth external electrodes 33 and 34 may be output terminals, but are not necessarily limited thereto.

The first and second coil patterns 21 and 22 may be formed on the same plane, which is the upper surface of the substrate 11, and the third and fourth coil patterns 23 and 24 may be formed on the same plane, which is the lower surface of the substrate 11, and the first and third coil patterns 21 and 23 may be connected to each other by a via (not illustrated).

Likewise, the second and fourth coil patterns 22 and 24 may be connected to each other by a via (not illustrated).

Therefore, current input from the first external electrode 31, which is the input terminal, may flow to the third external electrode 33, which is the output terminal, through the first coil pattern 21, the via, and the third coil pattern 23.

Likewise, a current input from the second external electrode 32, which is the input terminal, may flow to the fourth external electrode 34, which is the output terminal, through the second coil pattern 22, the via, and the fourth coil pattern 24.

The first to fourth coil patterns 21 to 24 may contain one or more selected from the group consisting of gold (Au), silver (Ag), platinum (Pt), copper (Cu), nickel (Ni), palladium Pd), and alloys thereof.

The first to fourth coil patterns 21 to 24 may be formed of any material that may provide conductivity to a coil, and are not limited to being formed of the above-mentioned metals.

In addition, the first to fourth coil patterns 21 to 24 may have a polygonal shape, a circular shape, an oval shape, or an irregular shape. However, shapes of the first to fourth coil patterns 21 to 24 are not particularly limited.

The first to fourth coil patterns 21 to 24 may be connected to the first to fourth external electrodes 31 to 34 through lead terminals (not illustrated), respectively.

The external electrodes may include the first to fourth external electrodes 31 to 34.

The first to fourth external electrodes 31 to 34 may be extended in the thickness direction ("T direction") of the magnetic body 10.

The first to fourth external electrodes 31 to 34 may be disposed to be spaced apart from each other to thereby be electrically disconnected from each other.

The first to fourth external electrodes 31 to 34 may be extended to portions of the upper and lower surfaces of the magnetic body 10.

Since bonded portions between the first to fourth external electrodes 31 to 34 and the magnetic body 10 have an angled shape, adhesive force between the first to fourth external electrodes 31 to 34 and the magnetic body 10 may be increased, and performance enduring external impacts, or the like, may be improved.

A metal forming the first to fourth external electrodes 31 to 34 is not particularly limited as long as it may provide electrical conductivity to the first to fourth external electrodes 31 to 34.

In detail, the first to fourth external electrodes 31 to 34 may contain one or more selected from the group consisting of gold (Au), silver (Ag), platinum (Pt), copper (Cu), nickel (Ni), palladium (Pd), and alloys thereof.

Gold, silver, platinum, and palladium may be more expensive, but may be stable, and copper and the nickel may be less expensive, but may be oxidized while being sintered, and thus electrical conductivity may be decreased.

In the coil component according to an exemplary embodiment, the gap member 40 may be disposed in one or more of upper and lower regions of the magnetic body 10 in the thickness direction to adjust an inductance value by causing interference between internal coils of a product.

As a result, various coupling values in a power inductor array product may be implemented.

For instance, although the first and second coil patterns 21 and 22 are basically disposed to be spaced apart from each other, since magnetic fluxes generated in the first and second coil patterns 21 and 22 are affected by each other due to miniaturization of the power inductor array product, interference may be generated by the gap member 40 to adjust the inductance value, whereby various coupling values may be implemented, if necessary.

Since the gap member 40 may be disposed in one or more of the upper and lower regions of the magnetic body 10 in the thickness direction, the gap member 40 may be disposed in only the upper region or the lower region of the magnetic body 10 in the thickness direction or may be disposed in both of the upper and lower regions of the magnetic body 10 in the thickness direction.

According to an exemplary embodiment, the gap member 40 may have a shape of a bar extended to be in contact with both side surfaces S2 and S5, for example, both internal side surfaces of the magnetic body 10 in the width direction, but is not limited thereto.

A width, a height, and a material of the gap member 40 may be variously changed, whereby various coupling values may be implemented, if necessary.

The gap member 40 may be formed by, for example, printing, but is not limited thereto.

A material of the gap member 40 is not particularly limited, but may be, for example, the same material as an insulating material disposed on the first to fourth coil patterns 21 to 24.

Therefore, the gap member 40 is not particularly limited, but may contain, for example, an epoxy resin, and may be formed by manufacturing a ceramic material such as glass, or the like, in a paste form and providing the ceramic material.

According to an exemplary embodiment, protrusion portions 41 may be disposed on one of the side surfaces of each of the two substrates 11, respectively.

The protrusion portions 41 may be formed together with the substrates 11 when the substrates 11 are manufactured, or may be formed separately from the substrates 11 after the substrates 11 are manufactured.

The protrusion portions 41 may be disposed on one of the side surfaces of each of the two substrates 11 to generate interference in a magnetic flux between the first and third coil patterns 21 and 23, thereby adjusting an inductance value. Therefore, various coupling values may be implemented, if necessary.

Likewise, interference may also be generated in a magnetic flux between the second and fourth coil patterns 22 and 24 due to the protrusion portions 41 to adjust an inductance value. Therefore, various coupling values may be implemented, if necessary.

A thickness of the magnetic body 10 may be 1.2 mm or less. However, a thickness of the magnetic body 10 is not limited thereto, and may be various.

Figure 5:
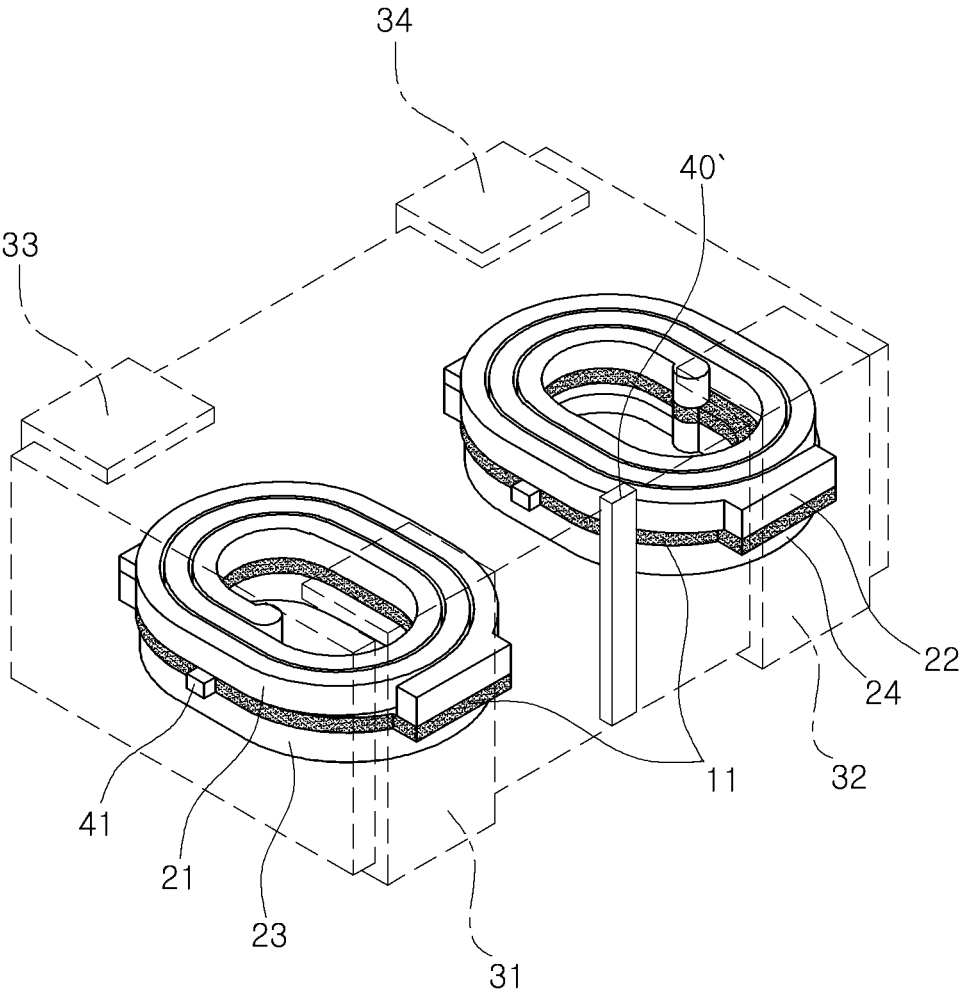
FIG. 5 is a perspective view of external electrodes and a magnetic body of a coil component according to another exemplary embodiment in the present disclosure.

FIG. 5 is a perspective view of external electrodes and a magnetic body of a coil component according to another exemplary embodiment.

Referring to FIG. 5, the coil component, according to another exemplary embodiment, may include a magnetic body 10 including first and second coil patterns 21 and 22 respectively disposed on first surfaces of two substrates 11 spaced apart from each other and having cores and third and fourth coil patterns 23 and 24 each disposed on second surfaces of the two substrates 11, and first to fourth external electrodes 31 to 34 disposed on outer peripheral surfaces of the magnetic body 10 and connected to the first to fourth coil patterns 21 to 24, respectively. Here, a gap member 40' may be disposed between the two substrates while being located on one or more of both internal side surfaces of the magnetic body 10 in the width direction.

According to another exemplary embodiment, the gap member 40' may be disposed on one or more of both internal side surfaces of the magnetic body 10 in the width direction. Therefore, a problem that magnetic fluxes generated in respective coil patterns are affected by each other due to miniaturization of an inductor array product may be solved by generating interference by the gap member 40' to adjust an inductance value. As a result, various coupling values may be implemented.

Since the gap member 40' may be disposed on one or more of both internal side surfaces of the magnetic body 10 in the width direction, the gap member 40' may be disposed on only one of both internal side surfaces of the magnetic body 10 in the width direction or may be disposed on both internal side surfaces of the magnetic body 10 in the width direction.

According to another exemplary embodiment, the gap member 40' may have a shape of a bar extended to the upper and lower surfaces S1 and S4, for example, internal upper and lower surfaces, of the magnetic body 10 in the thickness direction, but is not limited thereto.

A width, a height, and a material of the gap member 40' may be variously changed, whereby various coupling values may be implemented, if necessary.

For instance, according to an exemplary embodiment and another exemplary embodiment, the gap member 40 or 40' may be disposed in or on one or more of the upper and lower regions of the magnetic body 10 in the thickness direction and both internal side surfaces of the magnetic body 10 in the width direction.

A width, a height, and a material of the gap member 40 or 40' may be variously changed to control inductance values of respective coil patterns, whereby various coupling values may be implemented.

Board Having Coil Component

Figure 6:
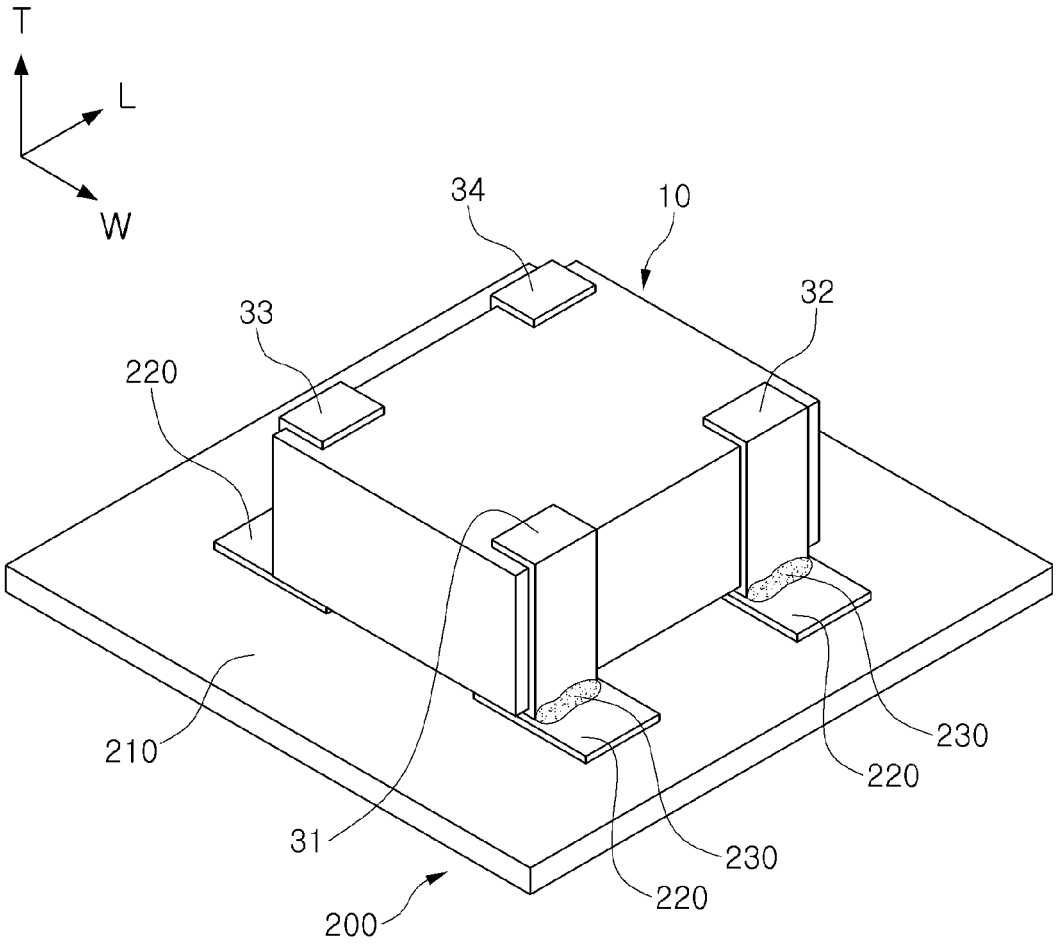
FIG. 6 is a perspective view illustrating a form in which the coil component of FIG. 1 is mounted on a printed circuit board.

FIG. 6 is a perspective view illustrating a board in which the coil component of FIG. 1 is mounted on a printed circuit board.

Referring to FIG. 6, a board having a coil component according to the present exemplary embodiment may include a printed circuit board 210 on which the coil component is mounted to be in parallel in regard to the circuit board, and a plurality of electrode pads 220 formed on an upper surface of the printed circuit board 210 to be spaced apart from each other.

Here, the coil component may be electrically connected to the printed circuit board 210 by solders 230. The first to fourth external electrodes 31 to 34 thereof may be positioned on the electrode pads 220, respectively, to contact the electrode pads 220, respectively.

A description of features overlapping those of the coil component according to the exemplary embodiment described above except for the above-mentioned description will be omitted.

As set forth above, in the coil component according to an exemplary embodiment, the gap member may be disposed in or on one or more of the upper and lower regions of the magnetic body in the thickness direction and both internal side surfaces of the magnetic body in the width direction to adjust an inductance value by causing interference between internal coils of a product.

As a result, various coupling values in a power inductor array product may be implemented.

While exemplary embodiments have been shown and described above, it will be apparent to those skilled in the art that modifications and variations could be made without departing from the scope of the present invention as defined by the appended claims.

What is claimed is:

1. A coil component comprising:

a magnetic body including first and second coil patterns respectively disposed on first surfaces of two substrates spaced apart from each other and having cores and third and fourth coil patterns respectively disposed on second surfaces of the two substrates; and first to fourth external electrodes disposed on outer peripheral surfaces of the magnetic body and connected to the first to fourth coil patterns, respectively, wherein a gap member is disposed between the two substrates while being located in at least one of upper and lower regions of the magnetic body in a thickness direction of the magnetic body, wherein the gap member is offset with first and second coil patterns in the thickness direction, and wherein a protrusion portion is disposed on a side surface of at least one of the two substrates, the side surface being perpendicular to the first and second surfaces.

2. The coil component of claim 1, wherein the gap member has a shape of a bar extended to be in contact with both internal side surfaces of the magnetic body in a width direction.

3. The coil component of claim 1, wherein the gap member is a printed gap member.

4. The coil component of claim 1, wherein the gap member is made of the same material as an insulating material disposed on the first to fourth coil patterns.

5. The coil component of claim 1, wherein the first and second external electrodes are provided as input terminals, and the third and fourth external electrodes are provided as output terminals.

6. The coil component of claim 1, wherein the first to fourth coil patterns contain at least one selected from the group consisting of gold (Au), silver (Ag), platinum (Pt), copper (Cu), nickel (Ni), palladium (Pd), and alloys thereof.

7. The coil component of claim 1, wherein the substrates are magnetic substrates.

8. The coil component of claim 1, wherein an insulating material is disposed on the first to fourth coil patterns.

9. The coil component of claim 1, wherein the gap member contains an epoxy resin.

10. The coil component of claim 1, wherein the magnetic body contains a metal based soft magnetic material having a particle size of 0.1 μm to 30 μm dispersed in a polymer selected from the group consisting of an epoxy resin and a polyimide.

11. The coil component of claim 1, wherein only one gap member is located in only one of the upper region and the lower region of the magnetic body in the thickness direction.

12. A coil component comprising:

a magnetic body including first and second coil patterns respectively disposed on first surfaces of two substrates spaced apart from each other and respectively having a core and third and fourth coil patterns respectively disposed on second surfaces of the two substrates, wherein a thickness direction of the magnetic body is perpendicular to the first and second surfaces, a length direction of the magnetic body and a width direction of the magnetic body are each perpendicular to the thickness direction, and a length of the magnetic body in the length direction is greater than a width of the magnetic body in the width direction; and first to fourth external electrodes disposed on outer peripheral surfaces of the magnetic body and connected to the first to fourth coil patterns, respectively, wherein a gap member is disposed between the two substrates while being located on at least one of both internal side surfaces of the magnetic body in the width direction of the magnetic body, the gap member is offset with the first and second coil patterns in the thickness direction of the magnetic body, and a thickness of the gap member in the thickness direction of the magnetic body is greater than a length of the gap member in the length direction of the magnetic body.

13. The coil component of claim 12, wherein an insulating material is disposed on the first to fourth coil patterns.

14. The coil component of claim 12, wherein the gap member contains an epoxy resin.

15. The coil component of claim 12, wherein the magnetic body contains a metal based soft magnetic material having a particle size of 0.1 μm to 30 μm dispersed in a polymer selected from the group consisting of an epoxy resin and a polyimide.

* * * * *